US005519263A

United States Patent [19]

Santana, Jr.

[11] Patent Number: 5,519,263

[45] Date of Patent: May 21, 1996

[54] THREE-WAY TOGGLE DIMMER SWITCH

[75] Inventor: George L. Santana, Jr., Eastlake, Ohio

[73] Assignee: Lamson & Sessions Co., The, Cleveland, Ohio

[21] Appl. No.: 109,168

[22] Filed: Aug. 19, 1993

[51] Int. Cl.[6] ..... H05B 37/02

[52] U.S. Cl. ..... 307/115; 307/114; 315/293; 315/361; 315/362

[58] Field of Search ..... 307/112, 113, 307/125, 126, 130, 131, 139, 140, 157, 114, 115, 116, 141.4, 141.8, 141; 315/194, 199, 299, 361, 362, DIG. 4, 293

[56] References Cited

U.S. PATENT DOCUMENTS 3,746,923 7/1973 Spira et al. .
3,949,347 4/1976 Gilbreath .
4,117,445 9/1978 Foreman et al. .
4,259,619 3/1981 Wall .
4,379,237 4/1983 Mosteller, Jr. ..... 307/194
4,455,546 6/1984 Roszel .
4,654,626 3/1987 Carsello .
4,742,188 5/1988 Buehler et al. .
4,871,893 10/1989 Slovak et al. .

*Primary Examiner*—William M. Shoop, Jr.
*Assistant Examiner*—Jonathan S. Kaplan
*Attorney, Agent, or Firm*—Fay, Sharpe, Beall, Fagan, Minnich & McKee

[57] ABSTRACT

A three-way toggle dimmer circuit controls the brightness of a lamp by independent operation of two light dimmer switches with each dimmer switch having its own electronic light dimmer circuit. Each of the light dimmer switches is arcuately actuated with one end of the vertical movement changing the electrical interconnection between the light dimmer switches. The other end of the vertical movement changes the internal electrical characteristics within the light dimmer circuit itself. The electronics of the light dimmer circuits are controlled by the position of a toggle arm through a linear slide potentiometer including both a variable slide resistor and a miniature internal switch.

14 Claims, 4 Drawing Sheets

THREE-WAY TOGGLE DIMMER SWITCH

BACKGROUND OF THE INVENTION

This application pertains to the art of light dimming circuits and more particularly to a three-way toggle dimmer switch combination using two independent toggle dimmer circuits for controlling the brightness of a lamp. In the past, many different types of electric circuits had been proposed for controlling the brightness of lamps or other lighting systems. At first, simple resistive load banks were used to absorb a portion of the voltage supplied to the lamp or lighting system application. This approach, however, is tremendously wasteful and inefficient.

Recent developments in solid state electronics have resulted in more efficient light dimming circuits. In particular, use of the silicon control rectifier (SCR) has become popular for this purpose. In an SCR, the conduction time of the current therethrough is controlled by varying the voltage applied to its gate terminal. It follows that this would allow the lamp or other lighting system to conduct for only a portion of a half-cycle, or a portion of the full cycle if the AC voltage was fully rectified.

Still further developments in the solid state electronics arts have lead to a triac device. A triac conducts during either half-cycle of standard AC line voltage depending upon the gate voltage applied to the triac. Traditionally, diacs have been used in combination with the triacs as triggering devices. As the names would imply, a triac is three terminal device whereas a diac is a two terminal device.

Basic electric circuits for controlling the brightness of lamps or lighting systems have been in existence for some time. However, a more complicated application is the three-way light dimming switch combination with independent dimmer circuits located in either switch, and with either switch having light dimming capabilities.

The prior U.S. Pat. No. 4,259,619 to Wall shows a fairly complex electromechanical apparatus having two separate light dimming circuits interconnected in a three-way light dimming switch combination. Each of the light dimmer switches has a common lead connected to a contactor arm. As a vertically actuated lever arm of either of the switches is moved from one limit of its vertical travel, a contact is broken. Also, as the vertically actuated lever arm moves to the opposite limit of its vertical movement, another contact is broken. As a result, the contactor arm of each dimming circuit requires two sets of contacts, one on each end, for proper circuit operation. Since the contactor arm is required to carry the full load current, the contacts and the arm itself must necessarily be ruggedized, and this requires a bulky and expensive structure.

An electronic dimmer circuit is interconnected between fixed contacts for the contactor arm in the prior arrangement disclosed by Wall for controlling the brightness of an associated lamp or lighting system. By proper connection of the fixed contacts of two light dimmer switches, and by using the common lead which connects to the actuator arm as the input and output, the intensity of a lamp can be varied from either light dimmer switch.

It has been found desirable to develop a new and improved three-way toggle dimmer switch and circuit which overcomes the above noted problems and others encountered with the prior art. The present invention meets these needs and others, and provides such a switch and circuit which is simple and easy to manufacture, efficient to operate, and less bulky than the prior devices.

SUMMARY OF THE INVENTION

According to the present invention, a three-way toggle dimmer switch combination is advantageously provided for variably controlling the brightness of lamps or lighting systems.

According to another aspect of the invention, the three-way toggle dimmer switch combination includes independent electronic dimmer circuits located in either switch. Further, either switch has light dimming capabilities based on the positions of the toggle actuator arms.

According to another aspect of the invention, a ruggedized contactor arm includes a single pole double throw switch for changing the electrical connection between the pair of three-way toggle dimmer switch circuits.

According to yet another aspect of the invention, a single pole single throw light-duty switch is included in each independent dimmer circuit for controlling the conduction time through a solid state thyristor.

According to a still further aspect of the invention, each independent dimmer circuit includes a slide potentiometer having both resistance varying capabilities and switching capabilities.

A primary advantage of the present invention resides in the reduced cost realized from the new, more efficient and simplified design.

Another advantage of the invention is found in the reduced complexity of manufacture due to a reduction in the overall number of components involved.

Still another advantage of the invention is realized in the slide potentiometer which facilitates both resistance varying and switching capabilities.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
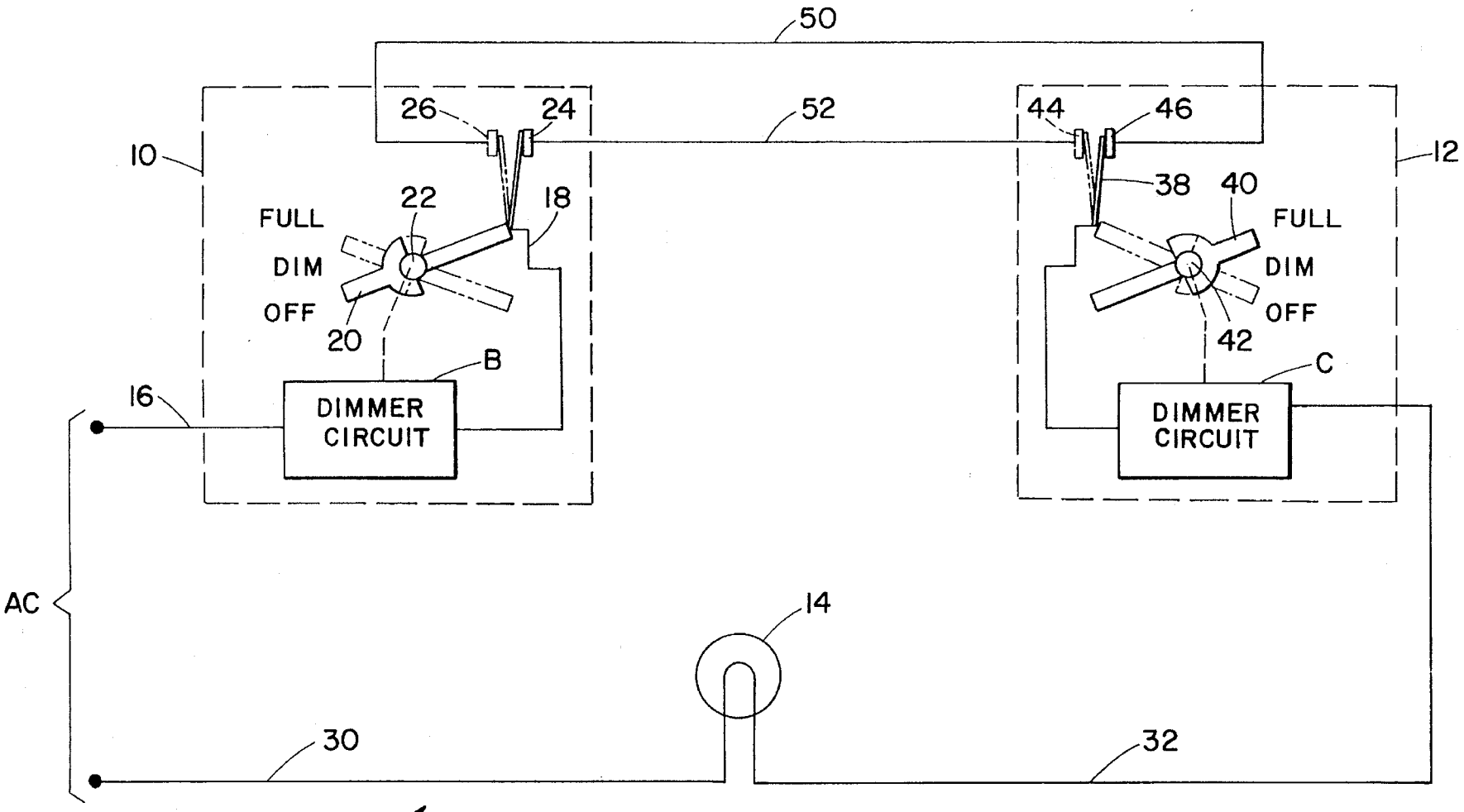
FIG. 1 is a pictorial schematic diagram showing the overall and internal connection of three-way toggle dimmer switches for three-way light dimming capabilities.

Referring now to the drawings, wherein showings are for purposes of illustrating the preferred embodiment of the invention only and not for the purposes of limiting same, the FIGURES show a three-way toggle dimmer switch combination A with first and second switches 10, 12, each having independent electronic dimmer circuits B, C, respectively, with either switch capable of light dimming.

More particularly, FIG. 1 shows an illustrative schematic diagram of a three-way connection between arcuately actuated light dimmer switches 10, 12 for providing three-way light dimming capability to a lamp 14. Input line 16 for standard A.C. voltage is connected to a first electronic dimmer circuit B with which the first light dimmer switch 10 is associated. The dimmer circuit B is, in turn, connected to a resiliently biased contactor arm 28. In the position shown in the FIGURE, the arcuately actuated lever arm 20 which operates about pivot 22 has depressed one end of the actuator arm 18 into electric contact with normally open (NO) contact 24. Both the NO contact 24 and the normally closed (NC) contact 26 are electrically connected to the dimmer circuit B through the contactor arm 18. Thus, when the arcuately actuated lever arm 20 is moved to the OFF position as illustrated, the contactor arm 18 will make electrical connection with the NO contact 24. When the arcuately actuated lever arm 20 is moved to the FULL position as illustrated in dotted lines, the actuator arm will relax and make electrical connection with the NC contact 26. When the lever arm 20 is moved from the FULL position to one between the extreme FULL and OFF positions, that is, in the DIM position, electrical connection is maintained between the dimmer circuit B to the NC contact 26 through the contactor arm 18.

Referring now to the second light dimmer switch 12 and associated other hardware, and with continued reference to FIG. 1, there is shown an illustrative schematic diagram of a three-way connection between arcuately actuated light dimmer switches 10, 12 for giving three-way light dimming capability to lamp 14. A second side of the input line 30 for standard A.C. voltage is connected through the load 14 and a wire 32 to a second dimmer circuit C of a second light dimmer switch 12. The dimmer circuit C is, in turn, connected to a contactor arm 38. In the position shown in the FIGURE as dotted lines, the arcuately actuated lever arm 40, which operates about pivot 42 has depressed one end of the contactor arm 38 into electric contact with normally open (NO) contact 44. Both the NO contact 44 and the normally closed (NC) contact 46 are electrically connected to the dimmer circuit C through the contactor arm 38. Thus, when the arcuately actuated lever arm 40 is moved to the OFF position, the contactor arm 38 will make electrical connection with the NO contact 44. When the arcuately actuated lever arm 40 is moved to the FULL position as illustrated, the actuator arm will make electrical connection with the NC contact 46. When the lever arm 40 is moved between the extreme FULL and OFF positions, that is, in the DIM position, electrical connection is made from the dimmer circuit C to the NC contact 46 through the contactor arm 38.

Interconnection between the two light dimmer switches 10, 12 is provided by wires 50 and 52. One end of wire 50 connects to NC contact 26 of the first switch 10, and the opposite end of wire 50 connects to NC contact 46 of the second switch 12. One end of wire 52 connects to NO contact 24 of switch 10, and the opposite end of wire 52 connects to NO contact 44 of switch 12. Light dimmer switch 12 is connected to lamp 14 by means of wire 32 connected to the dimmer circuit C. Also, the contactor arm 38 of switch 12 is connected to the dimmer circuit C directly. Lamp 14 is connected to the A.C. input voltage by means of wire 30.

Figure 4:
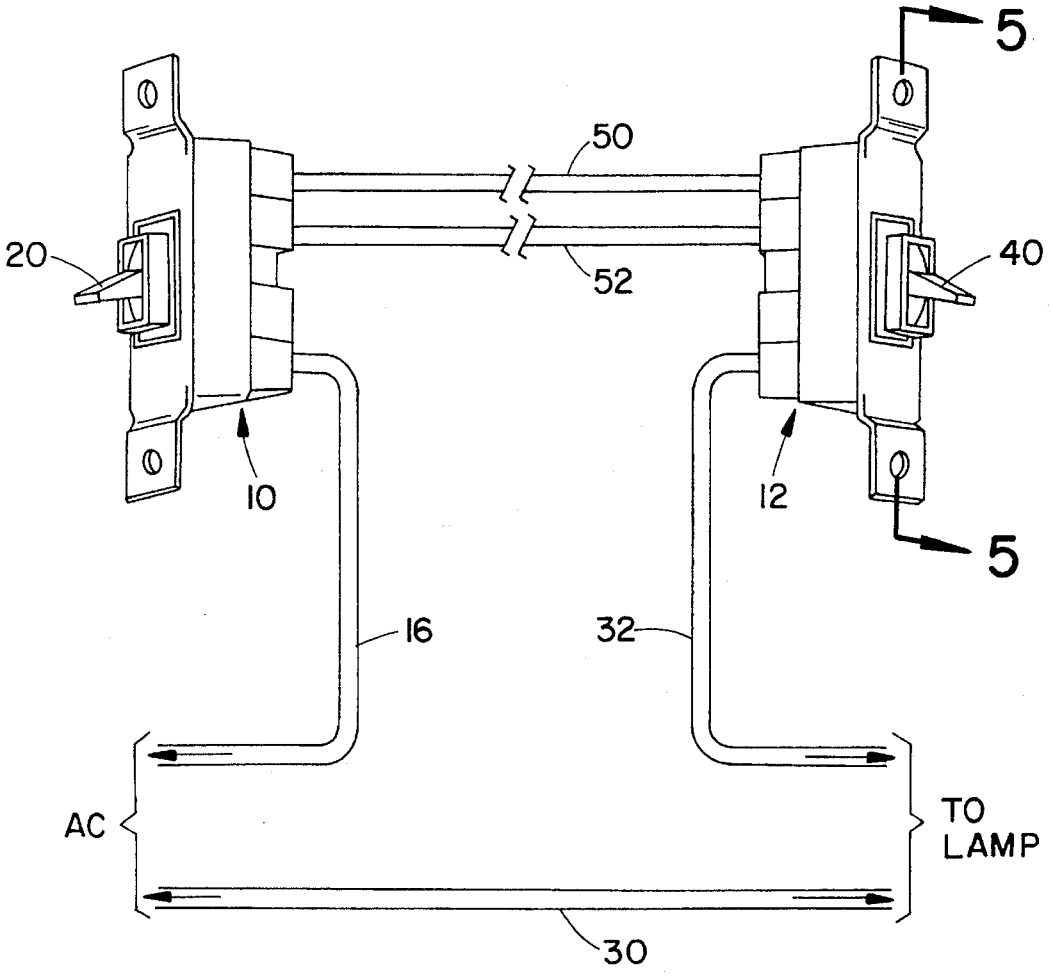
FIG. 4 is a pictorial representation of each three-way toggle dimmer switch as interconnected to household wiring.

With reference now to FIG. 4, the interconnection between the light dimmer switches 10, 12 is illustrated pictorially. Wires 50 and 52 interconnect the switches 10 and 12. Wire 16 connects the first switch 10 to the A.C. input voltage while wire 32 connects the second switch 12 to a lamp (not shown). Thereafter, the lamp is connected to the A.C. input voltage through wire 30.

Figure 2:
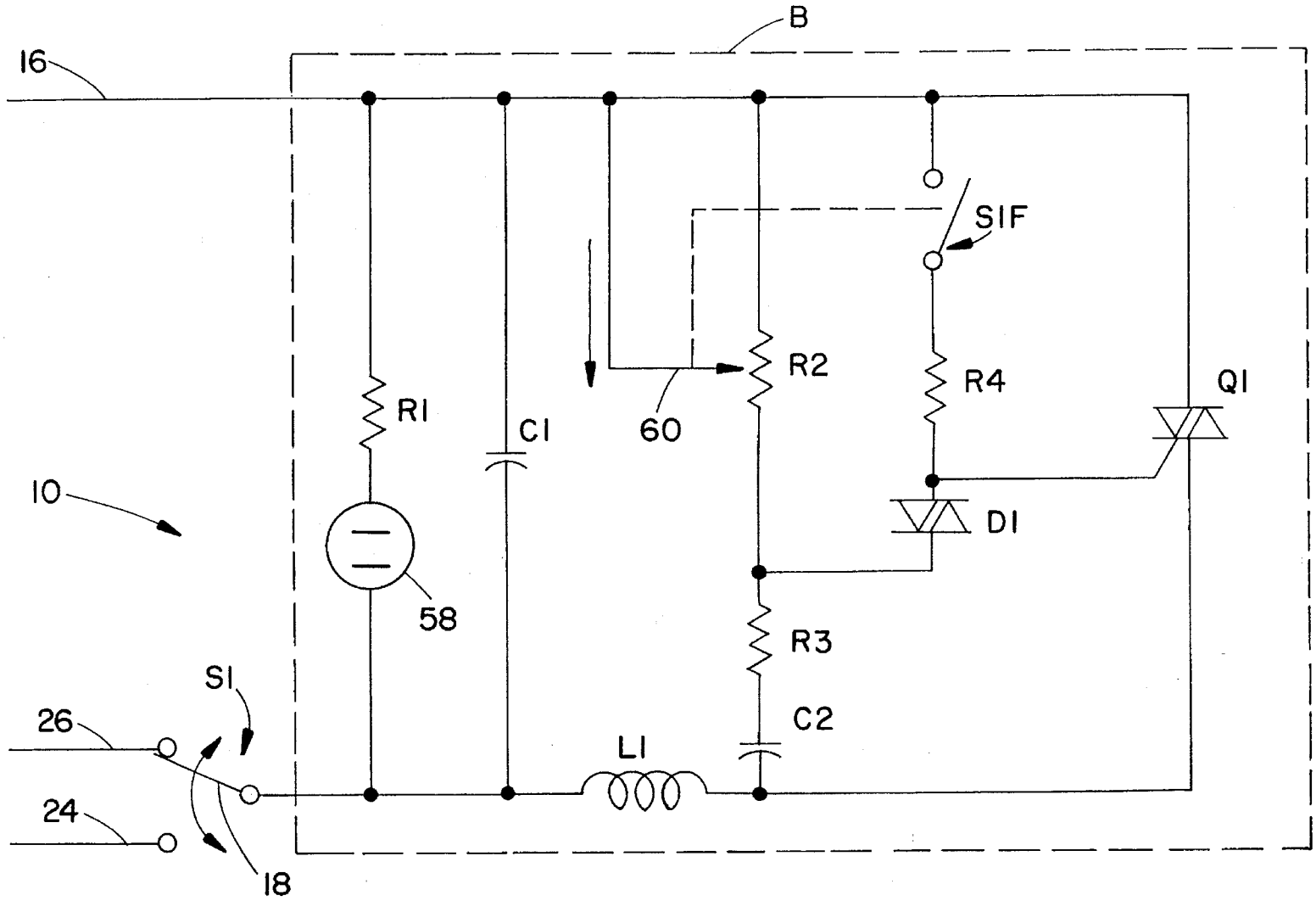
FIG. 2 is a detailed schematic diagram of a three-way light dimming switch circuit.

FIG. 2 of the drawings shows a detailed schematic diagram for light dimmer switch 10, it being appreciated that switch 12 is identical thereto unless otherwise specifically noted. The actuator arm (not shown) is in the DIM position, that is, toggled somewhere between the extreme FULL and OFF positions so control arm 18 is connected to the normally closed contact 26.

The A.C. input voltage is fed through the conductor 16 to the dimmer circuit B. As illustrated in the FIGURE, a diac D1 is connected between the gate of a triac Q1 and a voltage divider circuit. The voltage divider circuit is the series connection of two resistors and a capacitor R2, R3, and respectively. The resistor R2 is a variable resistor connected to the arcuately actuated toggle arm 20 (FIG. 1) in a manner described more particularly below. Also, an internal single pole single throw switch S1F connects the gate of the triac Q1 to the input voltage conductor 16 through a resistor R4. Further, the triac Q1 is connected in series with an inductor L1, which connects to a second dimmer switch 12 (FIGS. 1 and 2) through a single pole double throw switch S1. The switch S1 is formed by the contactor arm 18 and the NO and NC contacts 24 and 26, respectively. A filtering capacitor C1 shunts the triac Q1, and a neon bulb 58 is provided along with a series-connected current limiting resistor R1.

With reference to both of FIGS. 1 and 2, and as the lever arm 20 is toggled between the FULL and OFF positions, the position of the wiper arm 60 of the variable resistor R2 is also varied. As the position of the wiper arm 60 is varied with movement of the lever arm 20 toward the FULL position, the charge on the capacitor C2 is increased. As the charge on the capacitor C2 increases, the voltage across diac D1 also increases. When the limit voltage of diac D1 is exceeded, either positive or negative, diac D1 triggers conduction of triac Q1. By controlling the trigger point of diac D1 with variable resistor R2, the conduction of triac Q1 is also controlled. The RC circuit formed by resistor R3 and capacitor C2 provides a phase shift and a time delay in the triggering of diac D1.

By movement of lever arm 20 to the OFF position, contactor arm 18 breaks its electrical connection with NC contact 26 and makes an electrical connection with NO contact 24. By moving the lever arm 20 its FULL position, contactor arm 18 makes an electrical connection with NC contact 26 and, at the same time, closes switch S1F. As is apparent from the drawings, switch S1F connects the gate of the triac Q1 to the A.C. input voltage through a resistor R4 and a conductor 16. When this happens, the dimmer circuit B is forced into a "solid state relay" mode. In this mode, the triac Q1 is forced into a full ON condition. That is, the triac Q1 is ON or conducts current for substantially the entire A.C. input voltage cycle. The switch S1F is required to carry very little current and, therefore, is fabricated as part of the variable resistor R2 in a slide potentiometer housing to be further discussed hereinbelow. This reduces the cost of the contactor arms 18, 38 and enhances manufacturability of the switches.

Table 1 below sets forth the states of both switches S1 and S1F for the various positions of the toggle arm 20.

TABLE 1

| POSITION OF TOGGLE ARM 20 | STATE OF SWITCH S1 | STATE OF SWITCH S1F |
|---|---|---|
| FULL | on NC contact 26 | Closed |
| DIM | on NC contact 26 | Open |
| OFF | on NO contact 24 | Open |

Table 2 below sets forth the operating modes of the three-way toggle dimmer switches 10 and 12, along with the overall operating mode of the combined circuit 1.

TABLE 2

| POSITION OF TOGGLE ARM 20 | OPERATING MODE CIRCUIT B | POSITION OF TOGGLE ARM 40 | OPERATING MODE CIRCUIT C | OPERATING MODE OVERALL |
|---|---|---|---|---|
| FULL | ON | FULL | ON | ON |
| FULL | ON | DIM | DIMMER | DIMMER (12) |
| FULL | ON | OFF | OFF | OFF |
| DIM | DIMMER | FULL | ON | DIMMER (10) |
| DIM | DIMMER | DIM | DIMMER | DIMMER (10, 12) |
| DIM | DIMMER | OFF | OFF | OFF |
| OFF | OFF | FULL | ON | OFF |
| OFF | OFF | DIM | DIMMER | OFF |
| OFF | OFF | OFF | OFF | OFF |

The designations in the "OPERATING MODE OVERALL" column of Table 2 for the various situations resulting in a DIMMER mode indicates which of the two switches 10, 12 controls the power to the load. That is, in the situation of the second row, the second switch 12, controls the lamp brightness. Likewise, in the situation presented in the fourth row, the first switch 10 controls the power to the lamp. Lastly, both switches 10, 12 share the control over lamp brightness in the fifth row.

Table 3 below sets forth the component values used in the circuit of FIG. 2.

TABLE 3

| COMPONENT | VALUE |
|---|---|
| C1 | 0.1 μf, 200 v |
| C2 | 0.1 μf, 200 v |
| D1 | 32 v diode |
| L1 | 48 μH |
| R1 | 33 K Ω |
| R2 | 200 K Ω |
| R3 | 3.3 K Ω |
| R4 | 33 K Ω |
| Q1 | 8A/200 V triac |

Figure 3:
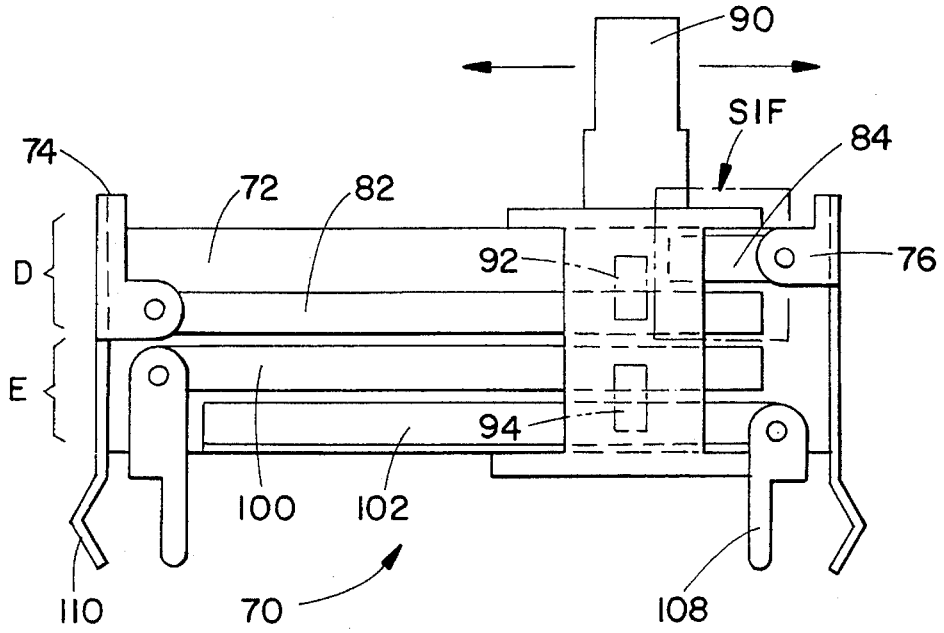
FIG. 3 is a detailed mechanical view of the slide potentiometer used in the dimmer circuits of FIGS. 1 and 2.

The slide potentiometer 70 which comprises the variable resistor R2 (FIG. 2) is illustrated in FIG. 3. The slide potentiometer is fabricated with a joined top half or switch portion D and a bottom half or variable resistor portion E. A common substrate 72 is generally rectangular and electrically non-conductive. A pair of posts 74, 76 extend along and traversely from two opposite edges of the substrate 72 for convenient connection to a printed circuit board (PCB).

With regard to the switch portion D of the slide potentiometer, a first conductive track 82 is formed on the substrate 72 to extend from the first post 74 toward the second post 76. A second conductive track 84 is likewise formed on the substrate to extend from the second post 76 toward the first post 74. As illustrated in FIG. 3, the first conductive track 82 extends substantially the entire length of the substrate 72, while the second conductive track 84 only partially extends from the second post 76. Spatially, there is a slight vertical overlap between the first and second conductive tracks 82, 84 as viewed in FIG. 3. Electrically, the tracks 82, 84 are isolated on the substrate 72.

A wiper arm 90 is slidable in a linear path along the directions illustrated, and carries thereon first and second conductive segments 92 and 94. The first conductive segment 92 is positioned on the wiper arm 90 to electrically connect the first and second conductive tracks 82, 84 when the wiper arm is at the extreme right end as illustrated in FIG. 3. When the wiper arm 90 is in this position, the first conductive segment 92 completes an electrical circuit shorting the first and second posts 74, 76. In effect, this position of the wiper arm closes the switch S1F (FIG. 2). Movement of the wiper arm 90 to the left away from the extreme right end position as viewed from the FIGURE, has the effect of opening the switch S1F. This occurs as the electrical connection between the left and right posts 74, 76 through the first and second conductive tracks 82, 84 is interrupted. There, the first conductive segment 92 no longer bridges the tracks 82, 84.

The variable resistor portion E of the slide potentiometer 70 comprises a first conductive track 100 and a second resistive track 102. The resistive track is formed directly on the substrate 72 and is electrically connected to a first resistor post 108. The conductive segment 100 is similarly disposed directly on the substrate 72 and is electrically connected to a second resistor post 110. As the wiper arm 90 is linearly displaced between the extreme ends of travel, the second conductive segment 94 electrically connects the first conductive segment 100 to the resistive segment 102. Movement of the wiper arm to the extreme left position as viewed in FIG. 3 maximizes the resistance between the first and second resistive posts 108, 110. In the extreme right position of the wiper arm 90, the resistance between the posts 108, 110 is minimized. The first and second conductive segments 92, 94 are electrically isolated since the wiper arm is constructed of a non-conductive material.

Figure 5:
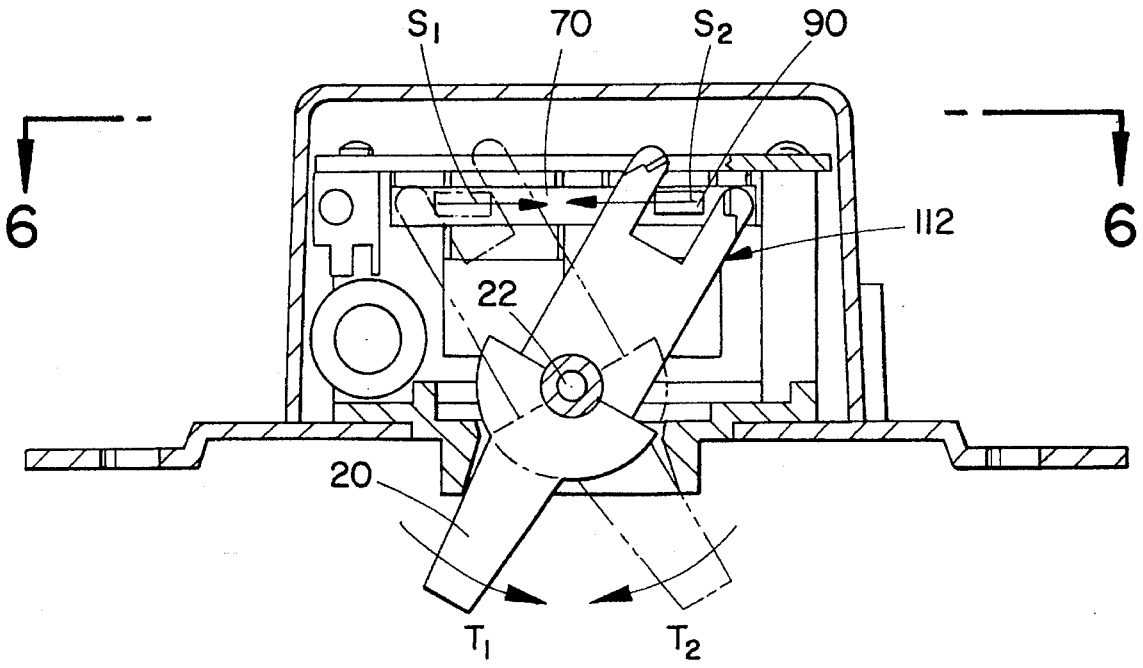
FIG. 5 is a cross-sectional view of a three-way toggle dimmer switch apparatus taken generally along line 5—5 of FIG. 4; and, FIG. 6 is a cross-sectional view of the three-way toggle dimmer switch taken generally along line 6—6 of FIG. 5.
Figure 6:
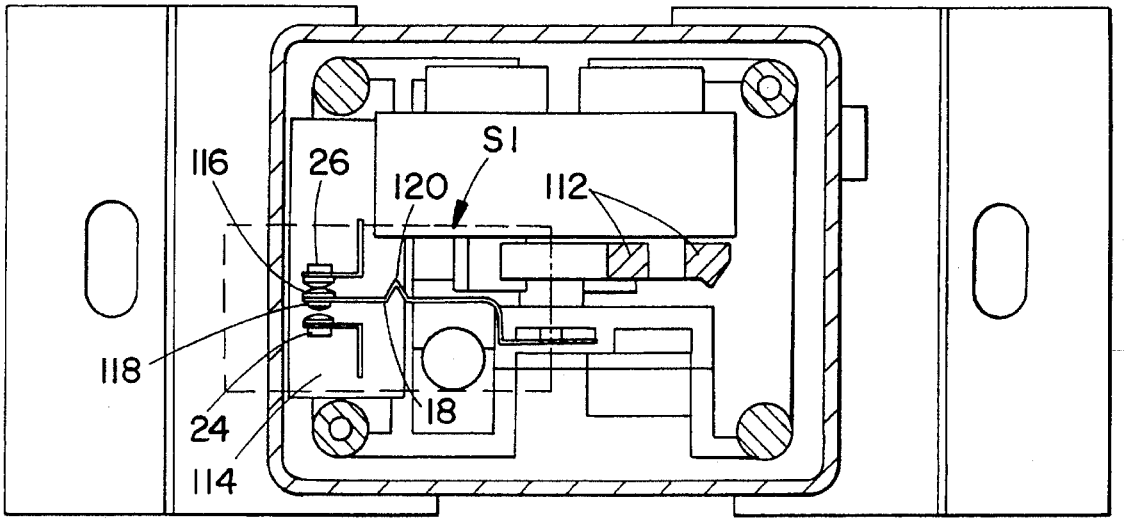

The mechanical interconnection between actuator arm 20, the slide potentiometer 70, and single pole double throw switch S1 is illustrated in FIGS. 5 and 6. For the purposes of illustration only, the first light dimmer switch 10 is shown in these FIGURES, it again being appreciated that switch 12 is identical thereto unless otherwise expressly noted. With reference first to FIG. 5, the actuator arm 20 is arcuately moveable about a pivot point Actuation of the arm 20 in a direction $T_1$ urges the wiper arm 90 of the slide potentiometer 70 in a first linear direction $S_1$. Similarly, actuation of the arm 20 in a direction $T_2$ urges the wiper arm 90 in the opposite direction $S_2$. The wiper 90 extends out of the page as viewed in the FIGURE and into a forked portion 112 of the arm 20.

With reference next to FIG. 6, the single pole double throw switch S1 is illustrated schematically. There, NC contact 26 and NO contact 24 comprise ruggedized electrical contacts fixed to a printed circuit board (PCB) 114. The contactor arm 18 carries a pair of opposite facing contacts 116, 118 for electrically connecting the contactor arm 18 to the NC contact 26 and the NO contact 24 respectively. As illustrated, the normal position of the contactor arm 18 is resiliently biased toward the NC contact 26. However, as the lever arm 20 moves in a direction $S_1$, the forked portion 112 engages a tab 120 whereupon the NC contact 26 is opened and the NO contact 28 is closed. This has the effect of switching the single pole double throw switch S1.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

Having thus described the invention I now claim:

1. A solid state switch for use in a switching circuit for varying power received by a load, the solid state switch comprising:

an electronic dimmer circuit connected between a first node and a second node, the electronic circuit including a triac having a first triac terminal connected to said first node, a second triac terminal connected to said second node, and a gate terminal connected to said first and second nodes through a variable voltage divider circuit;

moveable control means operatively connected with said variable voltage divider circuit for causing an impedance change in said voltage divider circuit as the control means moves; and, a first switch actuated at a first limit position of the moveable control means, said actuation of said first switch changing electrical connections between said gate terminal and at least one of said first and second nodes.

2. The solid state switch according to claim 1 wherein said variable voltage divider circuit comprises:

a potentiometer connected to a one of said first and second nodes; and, a first resistor connected to the other of said first and second nodes.

3. The solid state switch according to claim 2 wherein said first switch is connected between said one of said first and second nodes and said gate terminal.

4. The solid state switch according to claim 3 wherein said first switch comprises a single pole single throw switch.

5. The solid state switch according to claim 4 wherein said single pole single throw switch is fabricated as a part of the potentiometer in a potentiometer housing.

6. The solid state switch according to claim 5 further comprising a diac having a first diac terminal connected to said variable voltage divider circuit between said first resistor and said potentiometer, and a second diac terminal connected to said gate terminal of said triac.

7. The solid state switch according to claim 6 further comprising connecting means for connecting the solid state switch with an external operatively associated second solid state switch in a three-way switching circuit configuration for varying power received by said load.

8. The solid state switch according to claim 7 wherein said connecting means comprises a second switch actuated at a second limit position of the moveable control means, said actuation of said second switch changing electrical connections between at least one of said first and second nodes and first and second switch terminals on the solid state switch.

9. The solid state switch according to claim 8 wherein said second switch comprises a single pole double throw switch.

10. The solid state switch according to claim 9 wherein said moveable control comprises a lever arm and is arcuately moveable about a pivot.

11. The solid state switch according to claim 1 wherein said variable voltage divider circuit comprises a potentiometer connected to a one of said first and second nodes.

12. The solid state switch according to claim 11 wherein said first switch is fabricated as a part of the potentiometer in a potentiometer housing.

13. The solid state switch according to claim 12 wherein said first switch is connected between said one of said first and second nodes and said gate terminal.

14. The solid state switch according to claim 13 wherein said first switch comprises a single pole single throw switch.

* * * * *